US005282627A

United States Patent [19]

Beck

[11] Patent Number: 5,282,627

[45] Date of Patent: Feb. 1, 1994

[54] PUTTING TRAINER

[76] Inventor: Jack J. Beck, 1500 Country La., Kernersville, N.C. 27284

[21] Appl. No.: 986,713

[22] Filed: Dec. 8, 1992

[51] Int. Cl.[5] ..... A63B 69/36

[52] U.S. Cl. ..... 273/186.1; 273/192

[58] Field of Search ..... 273/192, 186.1, 191 R, 273/191 A, 191 B, 187.1, 187.6, 187 R, 187 A

[56] References Cited

U.S. PATENT DOCUMENTS

| | | | |
|---|---|---|---|
| 3,885,796 | 5/1975 | King | 273/186.1 |
| 4,111,426 | 9/1978 | Goodwin | 273/186.1 |
| 4,437,669 | 3/1984 | Pelz | 273/186.1 |
| 4,826,174 | 5/1989 | Hoyt | 273/192 X |
| 4,984,802 | 1/1991 | Barraclough | 273/192 |
| 5,014,994 | 5/1991 | Peters | 273/187 |

FOREIGN PATENT DOCUMENTS

| | | | |
|---|---|---|---|
| 26125 | of 1905 | United Kingdom | 273/192 |

*Primary Examiner*—George J. Marlo

[57] ABSTRACT

A putting trainer is provided along with a method to improve the putting stroke of golfers and includes a planar base having opposing side walls of different heights with inwardly projecting flanges at their upper ends under which the putter head is placed and is swung therealong to simulate putting a golf ball. The base comprises a series of perpendicular longitudinal and lateral lines which allow the golfer to easily determine the alignment of the putter head before, during and after the swing.

5 Claims, 2 Drawing Sheets

PUTTING TRAINER

BACKGROUND OF THE INVENTION

1. Field Of The Invention

The present invention pertains to a device to teach a golfer a correct swing, and particularly to assist golfers in learning and maintaining a correct putting stroke.

2. Description of the Prior Art and Objectives of the Invention

Golfers are well aware of the importance of a clean, straight putting stroke and its importance in lessening one's overall score. Many golfers practice for hours on conventional putting greens only to find their stroke has been practiced incorrectly or it is later determined that their putting swing has a slight horizontal arc. Also, many times golfers realize to late that they "lift" the putter during the swing causing incorrect contact with the ball and thus missing the hole.

Various types of putting correction devices have been conceived in the past such as shown in U.S. Pat. No. 4,437,669 which consist of a putting track to allow a golfer to learn how to properly swing a putter. Another such device is shown in U.S. Pat. No. 4,111,426 which includes a trough type mechanism which also is believed to help the golfer's swing. Another such device is shown in U.S. Pat. No. 3,885,796 which includes a stripe painted on the base to assist in the training swing.

While each of the aforesaid prior art devices may be useful in certain circumstances none of the devices as shown provide all the needed advantages for a putting trainer and accordingly it is one objective of the present invention to present a putting trainer and method for using the same which includes a base on which a grid is positioned for better viewing of the putting stroke before, during and after the swing.

It is another objective of the present invention to provide a putting trainer having front and rear walls with inwardly projecting flanges to maintain the putter thereunder during the swing.

It is still another objective of the present invention to provide a putting trainer which can be used by amateur or experienced golfers to help increase their putting accuracy.

Various other objectives and advantages of the present invention will become apparent to those skilled in the art as a more detailed description is set forth below.

SUMMARY OF THE INVENTION

A putting trainer and method are provided whereby an extruded plastic base having a pair of opposing walls with flanges positioned along the top thereof is used in teaching golfers a correct putting stroke. The base includes a grid having a series of heavy longitudinal lines which intersect in perpendicular fashion with a series of lateral lines spaced therealong. In use, the head of the golf club is positioned beneath one or both of the inwardly projecting flanges with the face of the putter parallel to one of the lateral grid lines. As the swing commences the golfer can view the face of the putter as it moves along the base over the grid to insure a correct club face position and swing.

DESCRIPTION OF THE PREFERRED EMBODIMENT

Figure 1:
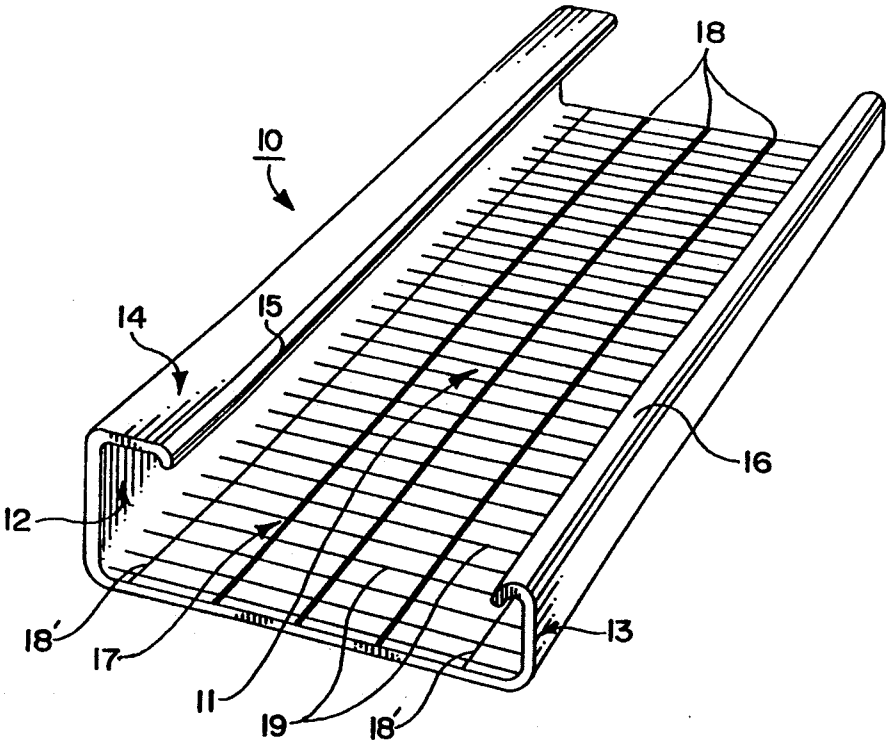
FIG. 1 demonstrates a perspective view of a putting trainer of the invention.

The preferred form of the invention is shown in FIG. 1 in which a putting trainer is extruded from a polyvinyl chloride composition which is approximately five inches in width, one-eighth inch thick, seventeen inches in length and has an overall height of approximately two inches. A printed grid is adhesively positioned on the base of the putting trainer to allow the user a good view in maintaining a smooth, even putting stroke. Front and rear vertical walls support inwardly projecting flanges which limit the vertical movement of the putter. The method of the invention comprises placing the putter head on the base beneath the inwardly projecting flanges, aligning the face of the putter in parallel with a lateral grid line proximate one end thereof, and swinging the putter along the base over the grid lines while maintaining the face of the putter parallel to the lateral grid lines therealong.

DETAILED DESCRIPTION OF THE DRAWINGS AND OPERATION OF THE INVENTION

For a better understanding of the invention and the method of use, turning now to the drawings, FIG. 1 demonstrates a perspective view of putting trainer 10 having a flat planar rectangular base 11 having a front wall 12 and a rear wall 13 vertically positioned thereon. Front wall 12 may have a height of approximately two inches whereas rear wall 13 may have a height of only one and one-quarter inches. Affixed atop front wall 12 is flange 14. As shown in FIG. 1, front wall flange 14 projects inwardly above and across base 11 and includes a curved tip 15 which extends downwardly from wall flange 14 approximately one-quarter of an inch. Rear wall 13 includes an arcuate flange 16 which has a diameter of approximately one-half inch. Putting trainer 10 can be extrusion molded from a suitable, durable polymeric material such as a polycarbonate, polyvinyl chloride or other conveniently available materials and of course could be molded or formed from aluminum or other materials. Putting trainer 10 as shown may have a thickness of approximately one-eighth of an inch although other suitable thicknesses, depending on the material employed could be utilized. Grid 17 is shown having three heavy (thick) central longitudinal lines 18 therealong and two light (thin) longitudinal lines 18' spaced at approximately one inch intervals along base 11 which intersect with perpendicular lateral lines 19 that are also relatively light in weight. Lateral lines 19 are spaced one-half inch apart and from end to end along base 11 which is approximately five inches wide and seventeen inches in length. Grid 17 is printed on an adhesive film and is applied to trainer 10 although grid 17 could be printed directly on trainer 10 or could be molded therein.

Figure 2:
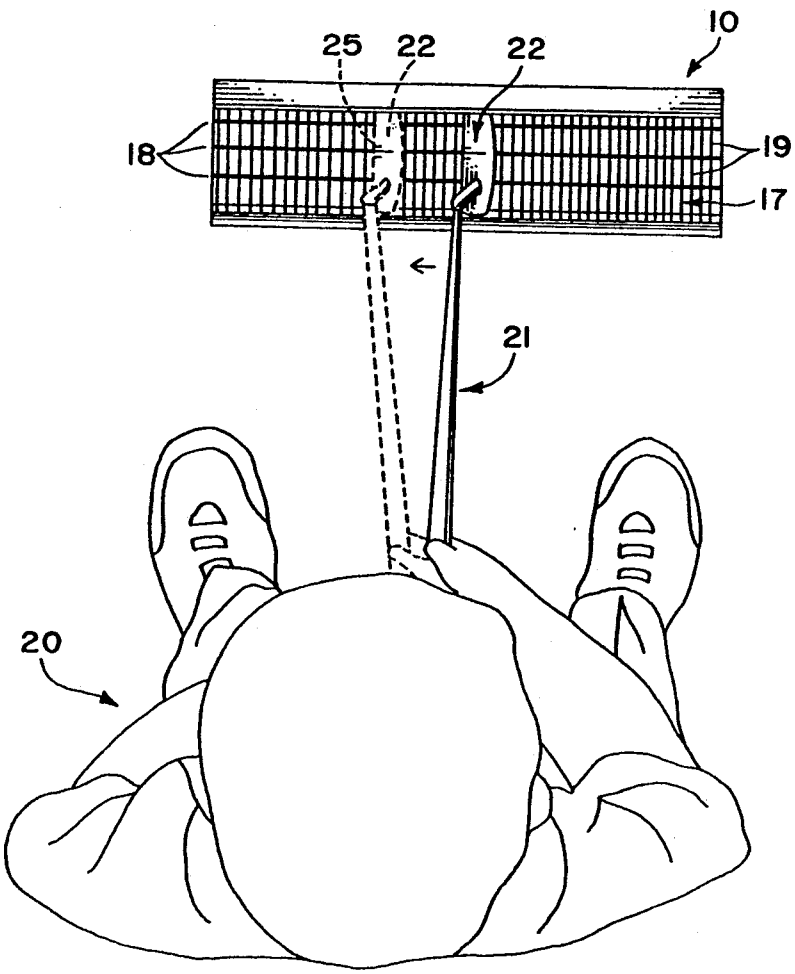
FIG. 2 shows a top view of golfer using the putting trainer.
Figure 4:
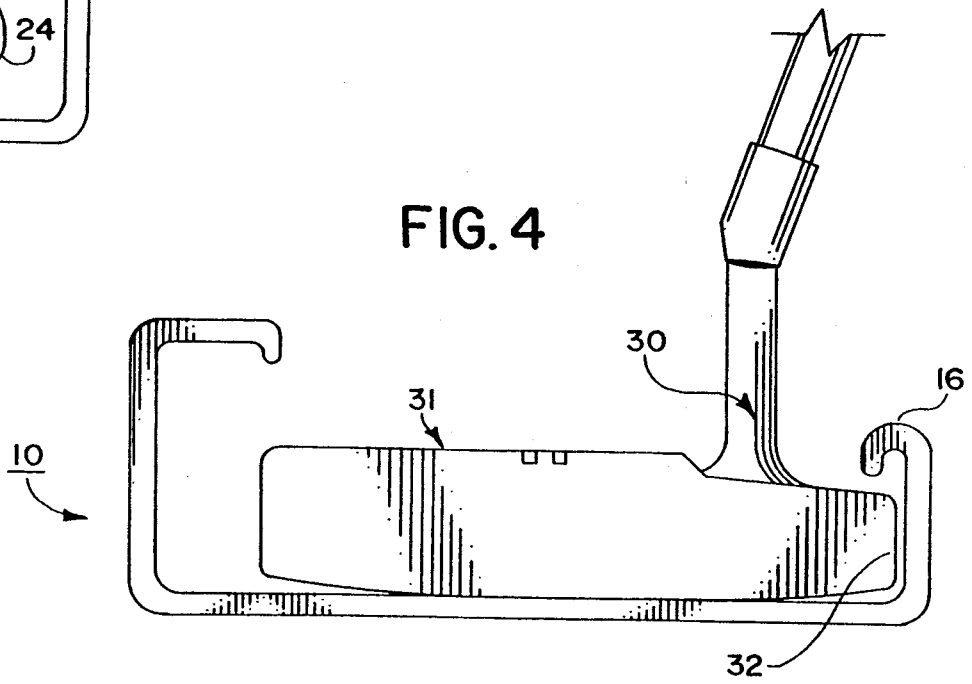
FIG. 4 illustrates a side elevational view of the putting trainer as seen in FIG. 3 with another type of golf club putter used therewith.
Figure 3:
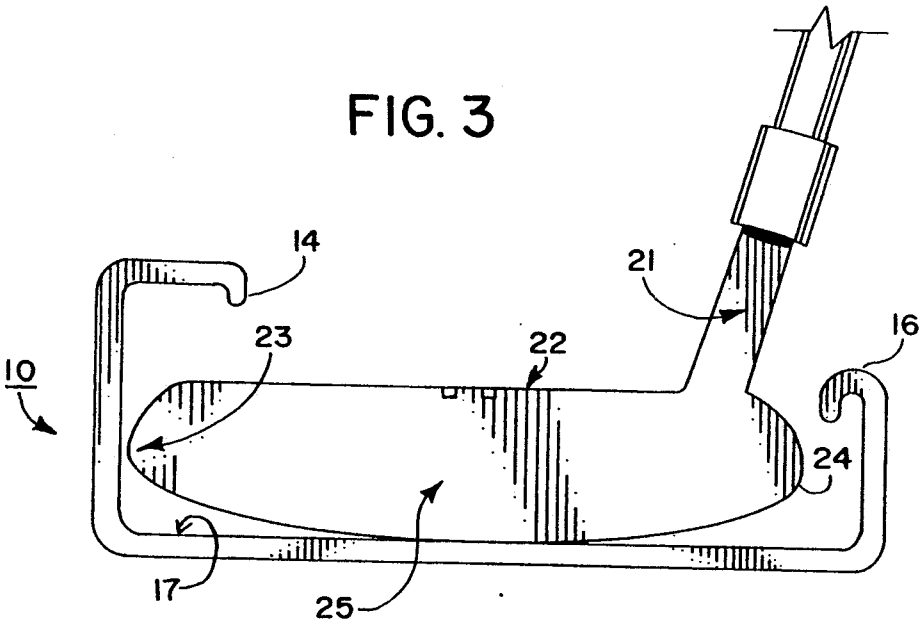
FIG. 3 illustrates a side elevational view of the putting trainer with a golf club therein.

In use, as seen in FIG. 2, golfer 20 places putter 21 in trainer 10 as further shown in FIG. 3 with nose 23 under front wall flange 14 and with heel 24 substantially clear of rear flange 16. With putter 21 so positioned, putter face 25 is moved into parallel alignment with lateral grid line 19 as shown in FIG. 2. Golfer 20 then swings putter 21 forward, making sure that putter face 25 maintains its parallel alignment with lateral grid lines 19 therealong to insure proper contact with a golf ball (not shown). As would be understood, front wall flange 14 prevents the golfer from pulling upwardly on putter 21 since flange 14 prevents undue upward movement of putter head 22 to insure a smooth even putting stroke. Arcuate flange tip 15 allows slight upward contact with putter 21 without diverting the stroke direction. In another embodiment in FIG. 4, putter 30 is shown having a head 31 and putter heel 32. Putter 30 is kept on a substantially level stroke as arcuate rear wall flange 16 prevents heel 32 from substantial tilting or lifting during the swing.

As shown in FIGS. 1 and 2, grid 17 comprises heavy central horizontal lines 18, and relatively light lateral lines 19 which intersect at right angles therealong. Heavy longitudinal lines 18 may have a thickness of approximately three thirty-seconds of an inch whereas lateral lines 19 and light longitudinal lines 18' may have a thickness of only one thirty-second of an inch. The additional thicknesses of longitudinal lines 18 greatly improves the ability of golfer 20 to view the putter as it moves along base 11 and provides a needed contrast to lateral lines 19.

By placing putter 21 within putting trainer 10 and aligning face 25 (FIG. 3) parallel to a lateral grid line 19, the putting stroke can be viewed and any upward pull on putter 21 can be felt as it contacts front wall flange 14, flange tip 15, or rear flange 16. Any horizontal arcuate movement of putter 21 is easily seen as face 25 departs from the parallel alignment with lateral grid line 19. With these variations to a level, straight motions felt and/or observed, the golfer can adjust his swing and practice until the correct swing is repetitiously accomplished and maintained.

The illustrations and examples provided herein are for explanatory purposes and are not intended to limit the scope of the appended claims.

I claim:

1. A putting trainer comprising: a base having planar upper and lower surfaces for positioning horizontally along the ground, a vertical front wall, a vertical rear wall, said front and said rear wall opposingly attached to said base and extending upwardly therefrom and being spaced apart a distance sufficient to permit the length of a conventional putter head to pass therebetween during a putting stroke, said front wall having a height greater than said rear wall, said front and said rear walls having inwardly projecting flanges, said flanges positioned at the top of said walls, a grid, said grid affixed to said base between said vertical walls and said grid comprising a series of perpendicular lines disposed longitudinally and laterally of said base.

2. A putting trainer as claimed in claim 1 wherein said front wall flange comprises an arcuate tip, said tip depending from said front wall flange.

3. A putting trainer as claimed in claim 1 wherein said rear wall flange comprises an arcuate member.

4. A putting trainer as claimed in claim 1 wherein said grid comprises three heavy longitudinal lines, two light longitudinal lines, and a plurality of light lateral lines, said longitudinal lines positioned perpendicularly to said lateral lines.

5. A putting trainer as claimed in claim 1 formed from a polymeric material.

* * * * *